US005549148A

United States Patent [19]

Figueiredo et al.

[11] Patent Number: 5,549,148

[45] **Date of Patent: *Aug. 27, 1996**

[54] BLADE FOR ACCORDION STORM SHUTTER

[75] Inventors: Pedro Figueiredo, Sunrise; Larry Verdon, Miramar; Norberto Valea, Miami, all of Fla.

[73] Assignee: Wrono Enterprise Corp., Hallandale, Fla.

[ * ] Notice: The term of this patent shall not extend beyond the expiration date of Pat. No. 5,477,903.

[21] Appl. No.: 286,503

[22] Filed: Aug. 5, 1994

Related U.S. Application Data

[63] Continuation-in-part of Ser. No. 252,559, Jun. 1, 1994, Pat. No. 5,477,903.

[51] Int. Cl.[6] ..... E05D 15/26

[52] U.S. Cl. ..... 160/183; 160/233

[58] Field of Search ..... 160/183, 233, 160/235, 196.1, 199, 206, 236, 229.1, 213, 113, 114, 118, 119, 135

[56] References Cited

U.S. PATENT DOCUMENTS

| | | | |
|---|---|---|---|
| 2,042,354 | 5/1936 | Munson . | |
| 2,641,018 | 6/1953 | Snyder | 160/235 |
| 3,335,784 | 8/1967 | Risk et al. | 160/199 |
| 3,359,594 | 12/1967 | Pastoor | 160/235 X |
| 3,529,651 | 9/1970 | Bender | 160/183 |
| 3,670,797 | 6/1972 | Sassano . | |
| 3,720,255 | 3/1973 | Ueda . | |
| 3,799,237 | 3/1974 | Proserpi | 160/199 |
| 4,386,645 | 6/1983 | Dever et al. | 160/183 |
| 4,922,987 | 5/1990 | Marontate et al. . | |
| 5,036,953 | 8/1991 | Munz | 160/196.1 X |
| 5,097,883 | 3/1992 | Robinson et al. . | |
| 5,099,904 | 3/1992 | Susnar . | |
| 5,220,951 | 6/1993 | Dagenais . | |

*Primary Examiner*—David M. Purol
*Attorney, Agent, or Firm*—Shoemaker and Mattare, Ltd.

[57] ABSTRACT

An accordion storm shutter assembly includes a frame for installation in an opening in a building wall and a pair of folding shutters which can be drawn together across the opening. Each shutter is formed from a number of blades articulated along vertical edges so that the blades can fold flat when the shutter is open. When the shutter is closed, the blades make a substantial angle with one another, so that the shutter has a corrugated configuration for high impact resistance. Neighboring blades are interconnected by continuous extruded linear hinges, each including a socket which is substantially an arc of a cylindrical shell having a lengthwise gap, and a knuckle adapted to turn within the socket and having a blade arm extending therefrom through the gap. The shutter is intended to provide protection against winds and debris in tropical storms.

4 Claims, 9 Drawing Sheets

CLOSE POSITION

OPEN POSITION

BLADE FOR ACCORDION STORM SHUTTER

This is a continuation-in-part of patent application No. 08/252,559., filed Jun. 1, 1994, now U.S. Pat. No. 5,477,903.

BACKGROUND OF THE INVENTION

This invention relates generally to closures, and more particularly to a blade for accordion-type metal storm shutters.

There are code requirements in Florida and other jurisdictions for storm shutters. The south Florida building code, applicable to Dade and Broward counties, specifies that storm shutters must be able to withstand the impact of a two-by-four, weighing nine pounds, moving at 50 feet per second, simulating the impact of debris during a hurricane. There are also standards for the ability to withstand wind pressure, including negative pressures, and fatigue loading tests. Many older steel roll shutters and the like are not capable of meeting these specifications.

Application No. 08/252,559 describes a shutter having plural extruded aluminum alloy blades. Neighboring blades are connected to one another by hinge members, each comprising a "socket" on one blade, and a "knuckle" on a neighboring blade, which fits within the socket. The blades are designed to limit hinging movement to about 90°, so that the angle between hinged blades is always acute. As a result, the shutter, when drawn, has a corrugated configuration that provides great strength.

This application discloses a modified form of the blade shown in the prior application. The modified blade is characterized by light weight, and a high strength-to-weight ratio.

SUMMARY OF THE INVENTION

An object of the invention is to provide a strong storm shutter capable of withstanding impacts from flying debris during tropical storms and high wind load pressures.

Another object of the invention is to provide a strong, lightweight articulated blade for a storm shutter.

These and other objects are attained by the accordion storm shutter assembly described in detail below. The assembly includes a frame for installation in an opening in a building wall and a pair of folding shutters which can be drawn together across the opening. Each shutter is formed from a number of blades articulated along vertical edges so that the blades can fold flat when the shutter is open. When the shutter is closed, the blades make a substantial angle with one another, so that the shutter has a corrugated configuration for high impact resistance. Neighboring blades are interconnected by continuous extruded linear hinges, each comprising a socket which is substantially an arc of a cylindrical shell having a lengthwise gap, and a knuckle adapted to turn within the socket and having a blade arm extending therefrom through the gap.

The shutter is intended to provide protection against winds and debris in tropical storms.

BRIEF DESCRIPTION OF THE DRAWINGS

In the accompanying drawings.

DESCRIPTION OF THE PREFERRED EMBODIMENT

An accordion storm shutter embodying the invention includes a rectangular frame 10 (FIG. 1) comprising a top member 12, a pair of geometrically similar wing panels 14, 16, and a bottom member 18. These parts are custom cut, or precut, to fit a window or door opening in a building. Each of the frame members is extruded from, preferably, an aluminum alloy.

Figure 4:
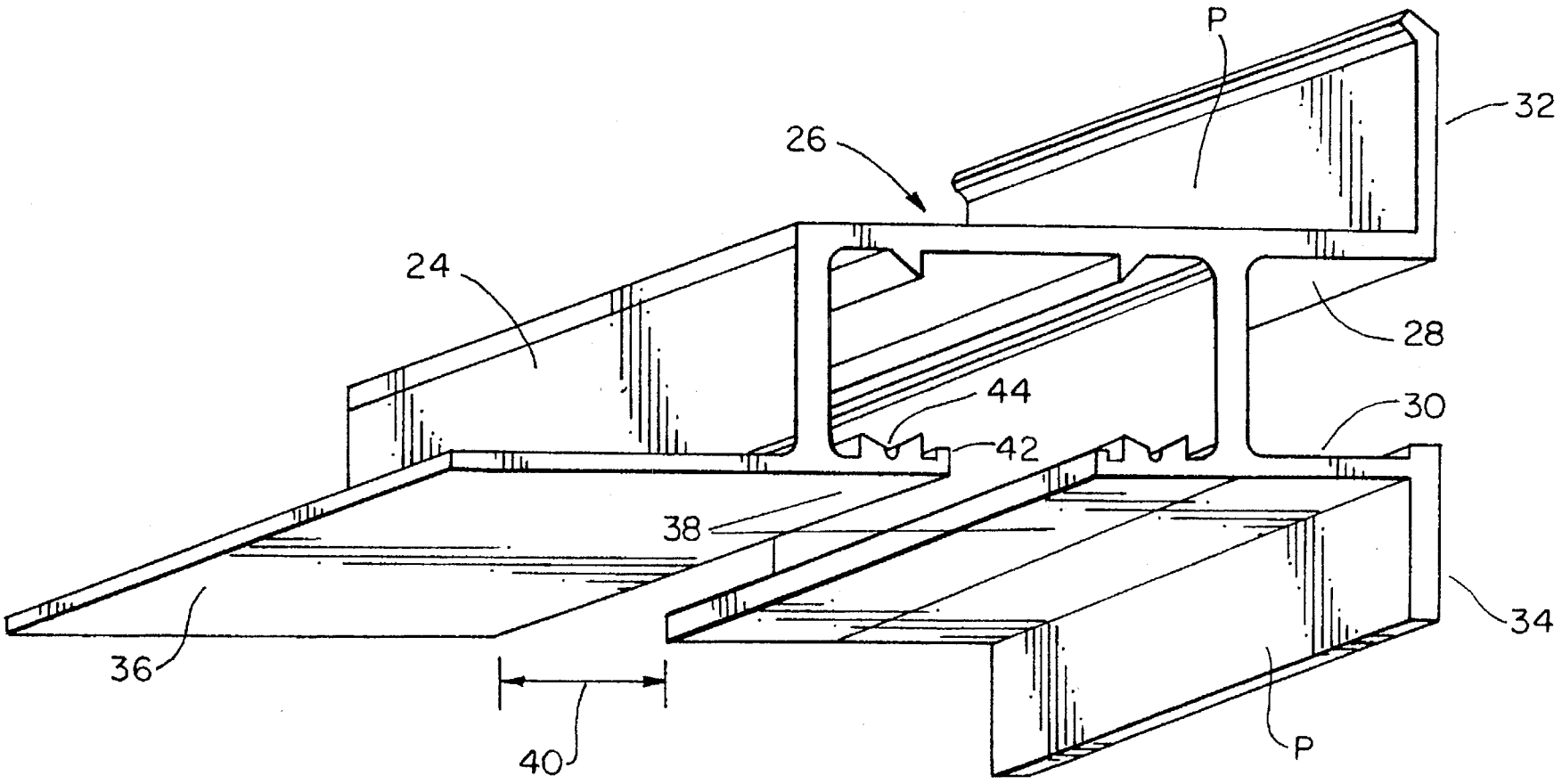
FIG. 4 is a perspective view of a wall frame member shown in FIG. 1.
Figure 8:
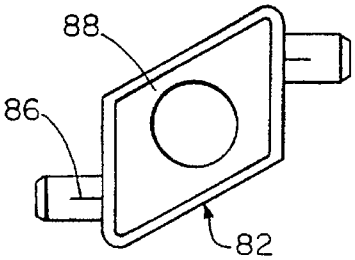
FIG. 8 is top detail view of a trolley described in detail below.

For window installations on the wall of a building, the top member 12 (FIG. 4) comprises a downwardly-open U-channel 24 having a base 26 with integral wings 28,30 extending to one side. Each wing has a foot 32 or 34 forming a vertical surface which goes against the wall surface. A broad extension flange 36, parallel to the wings, extends from one arm of the "U" to the opposite side, that is, away from the wall. Smaller internal flanges 38 on either arm of the "U" define a gap 40 therebetween about 0.7 inch wide. Each internal flange has a small inturned lip 42 at its free edge, and a raised, grooved, track element 44 running parallel to the lip, hidden inside the channel.

Figure 5:
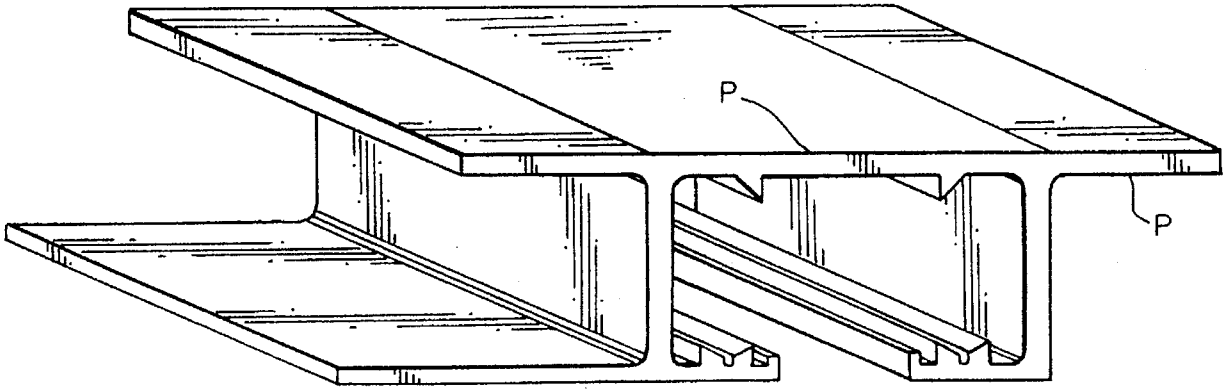
FIG. 5 is a perspective view of a ceiling track member used in certain applications other than FIG. 1.
Figure 6:
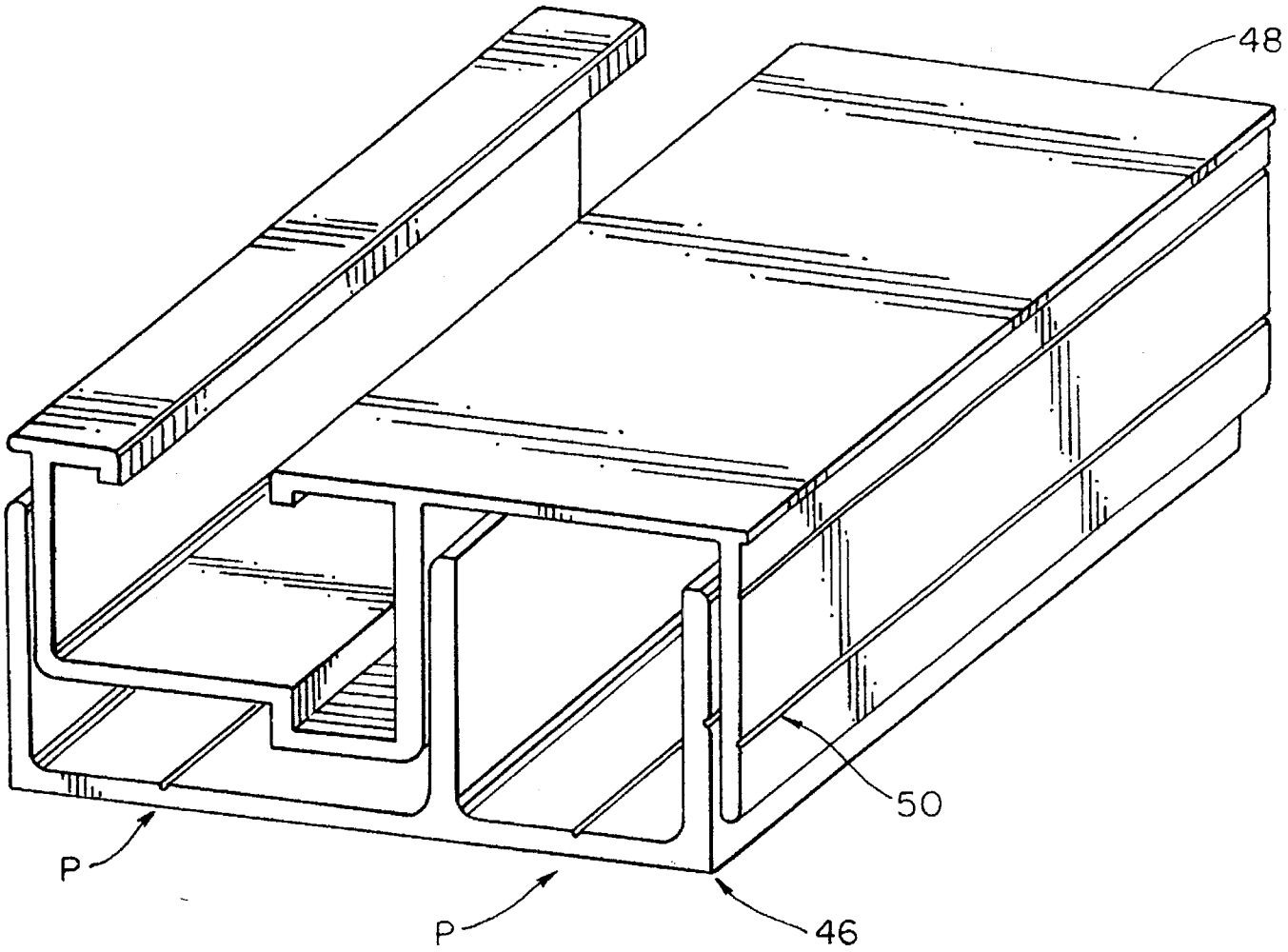
FIG. 6 is a perspective view of a floor track member used in application other than that of FIG. 1.
Figure 7:
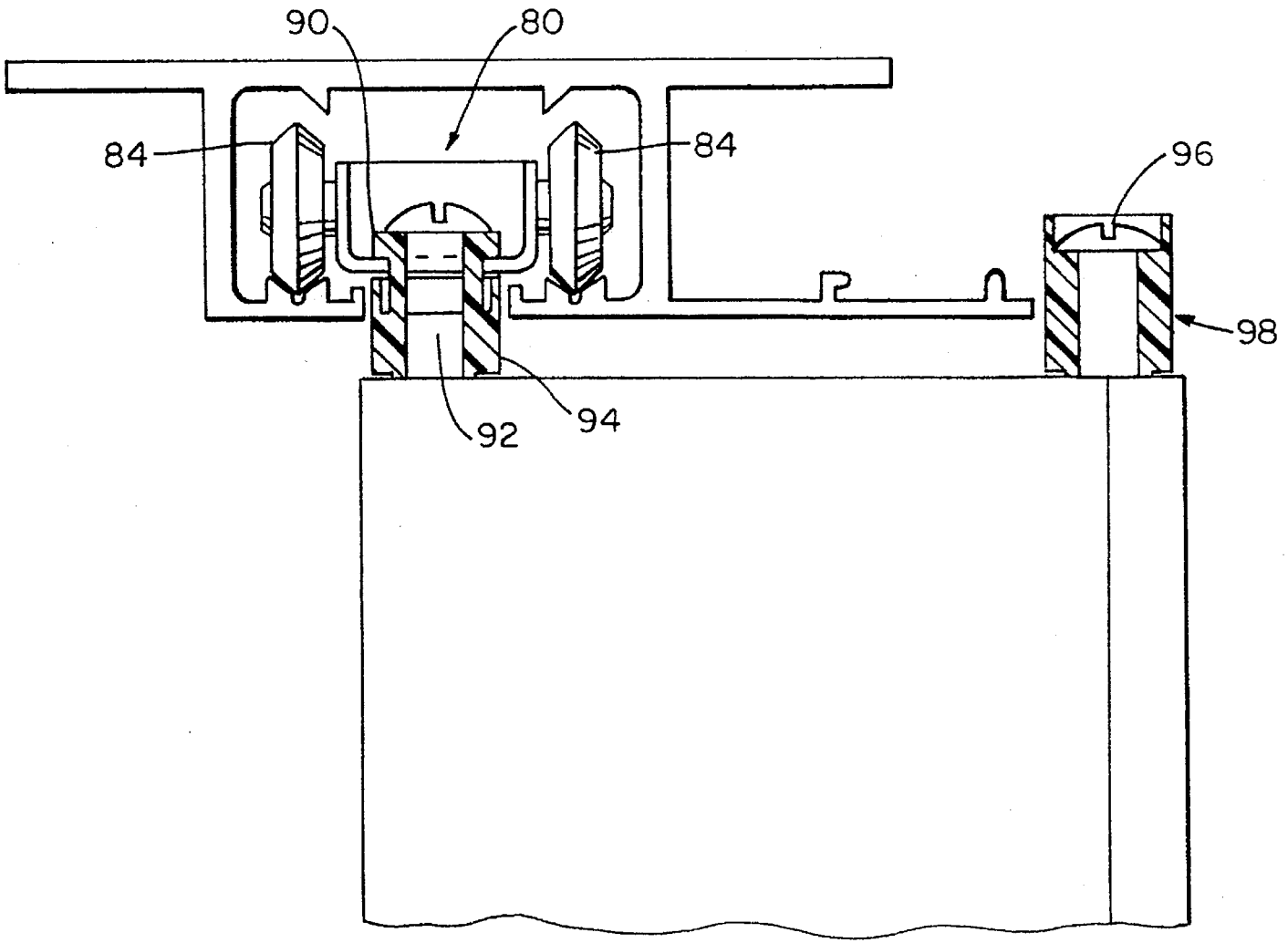
FIG. 7 is a sectional view on a vertical plane through the shutter frame of FIG. 1, showing how the shutter blades are suspended in the frame.
Figure 9:
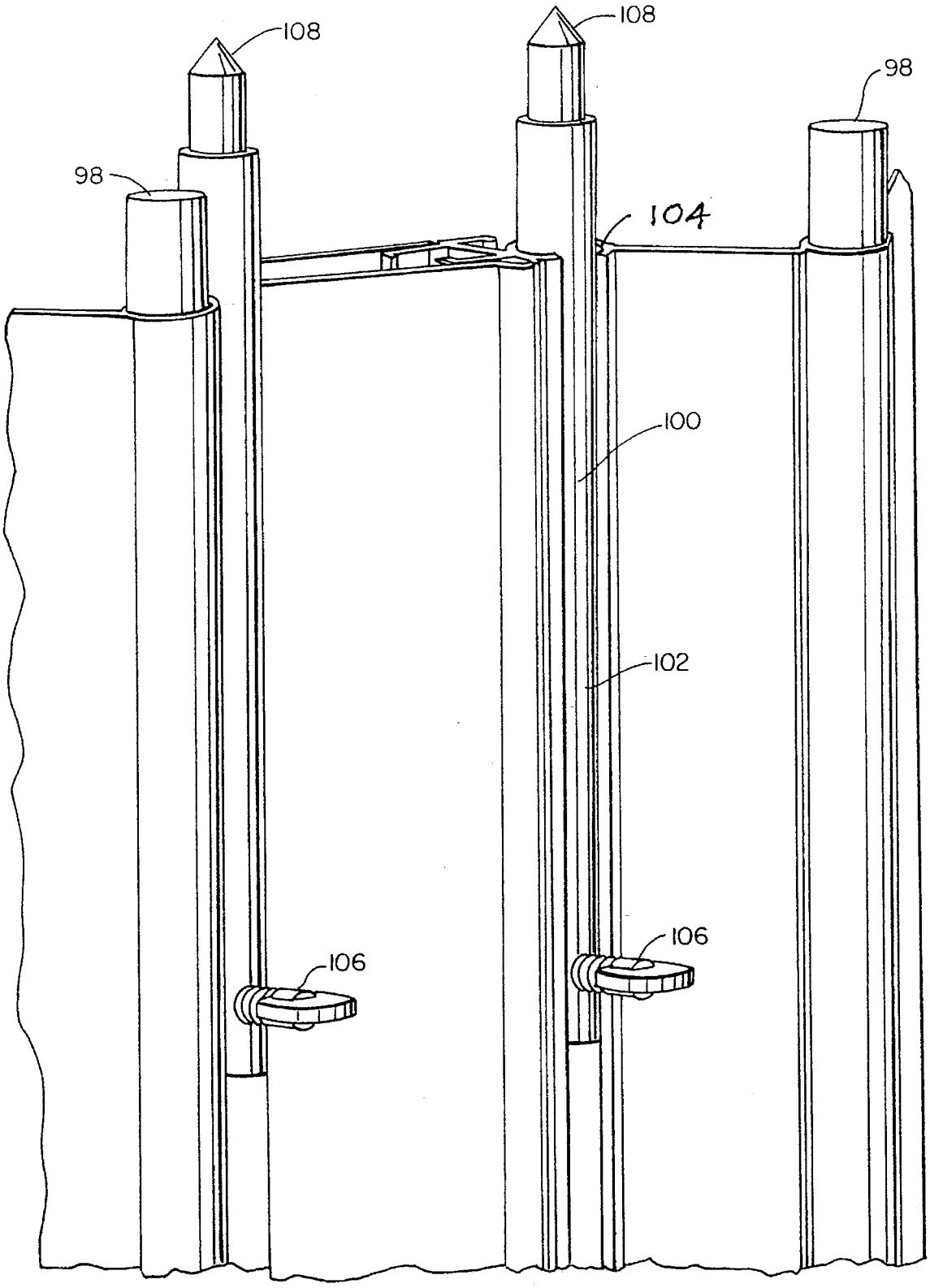
FIG. 9 is a an isometric view of a top portion of the shutter, without its frame, showing locking pins for securing the shutters.

For window installations, the bottom member 18 of the frame is identical to the top member, except inverted, so that the gap faces upward.

Where a track has to be installed on an existing ceiling or floor, the design of the top and bottom members is modified, as shown in FIGS. 5 and 6. The ceiling member shown in FIG. 5 is like the element previously described, except that the wings are now on either side of the channel, for flush mounting to the ceiling.

The floor member shown in FIG. 6 is an assembly of two parts: an "E" channel anchor base 46 having narrow and wider recesses separated by a partition corresponding to the middle arm of the "E", and a cover 48 which nests within the anchor base. The cover comprises a "U" channel having internal, lipped flanges at the tips of its arms (like the top member), and an integral "L" section 50 extending along one side. The channel portion of the cover is sized to fit within the large recess of the anchor base, and the "L"

section extends just outside the remaining arm of the anchor base.

Regardless of the type of installation, the top and bottom members are affixed to the structure at points "P" by fasteners (not shown). The edges of the shutter comprise fixed wing panels 14,16 having a flat mounting portion which can be attached directly to the structure, or via "L" section channel members, if necessary. Each wing panel is an extruded member having a hinge joint socket or knuckle formed along its free vertical edge. Details of the hinge joints are described further below.

Figure 1:
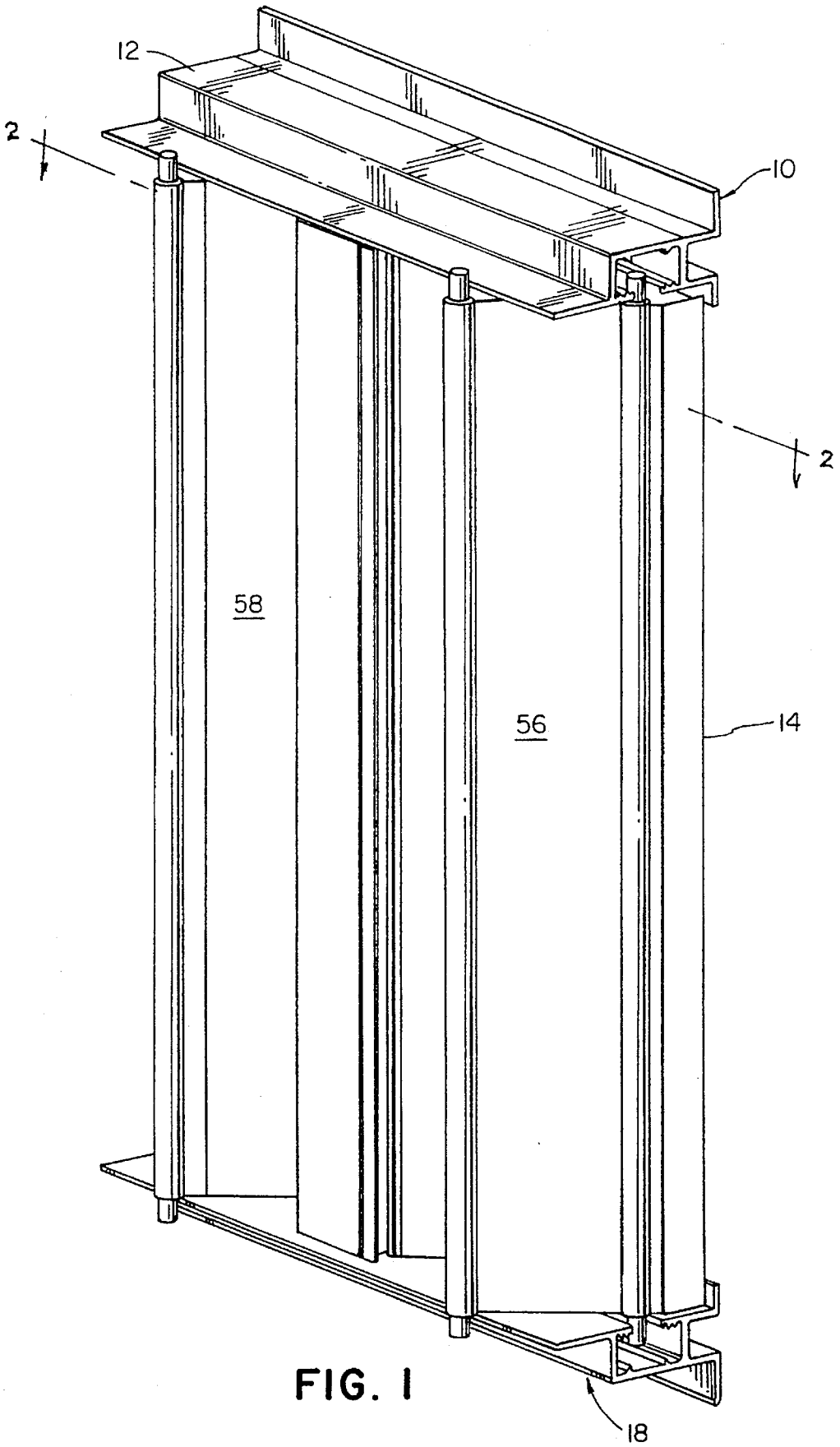
FIG. 1 is a perspective view of an accordion storm shutter assembly embodying the invention, as seen from outside the building.
Figure 2:
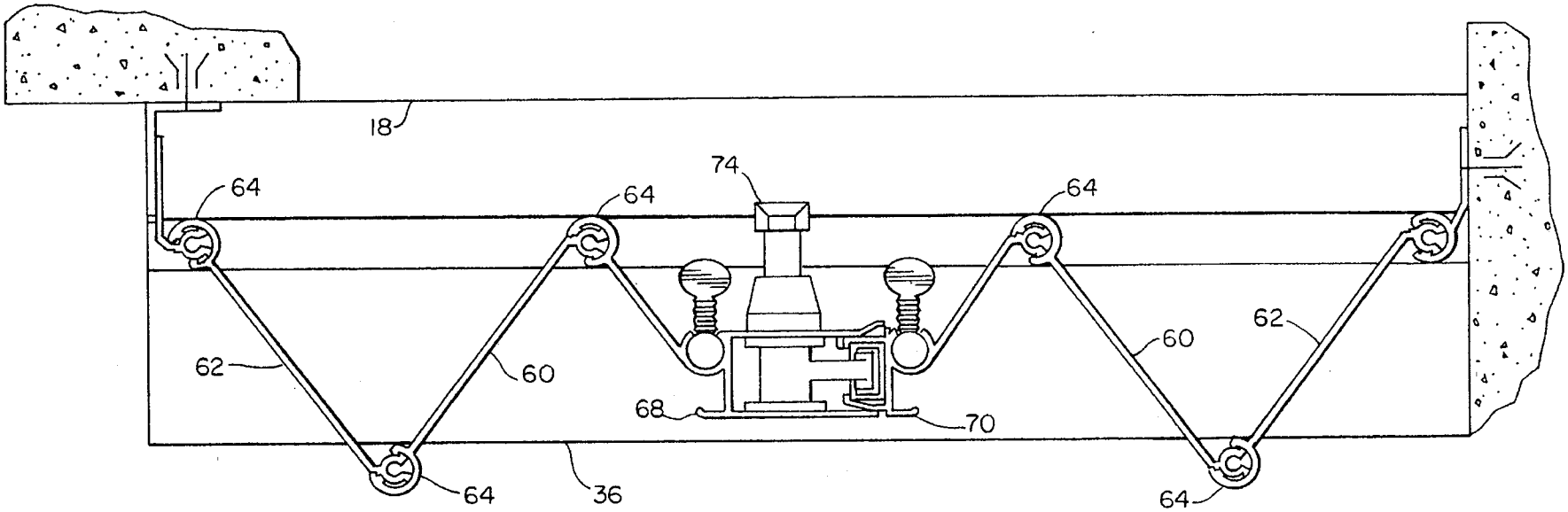
FIG. 2 is a top plan section thereof, taken on the plane 2—2 in FIG. 1.
Figure 3:
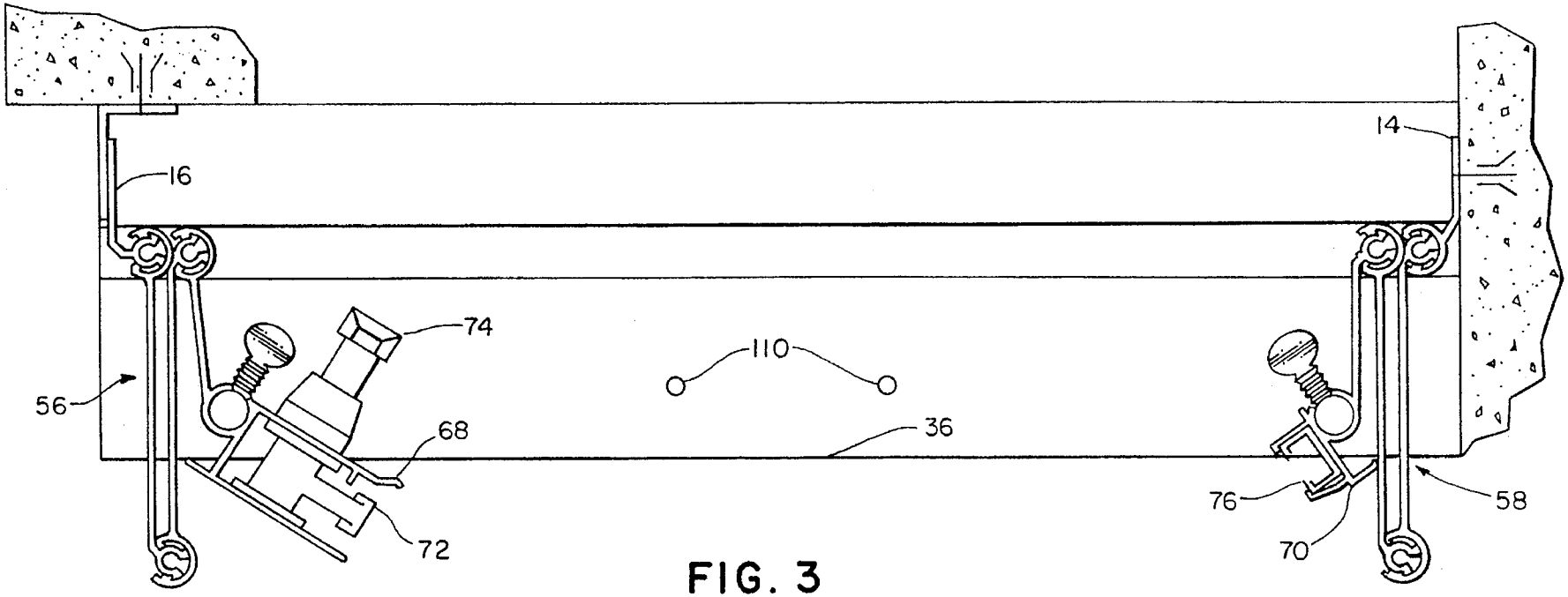
FIG. 3 is a view corresponding to FIG. 2, showing the shutters open.

Now, as one can see from FIG. 1, the frame contains a pair of shutters 56,58 which can be drawn laterally from an open position (FIG. 3) to a closed position (FIGS. 1 and 2). Each shutter comprises at least two extruded aluminum alloy blades 60,62, which are articulated by hinges 64. The outer blade 62 is connected by a similar hinge to one of the wing panels 14,16. The inner blade 60 is hinged to a respective jamb panel. The jamb panels 68,70 have different geometries: one (68) is adapted to contain a latch mechanism 72, whose handle 74 protrudes into the living space; the other (70) contains a catch 76 engaged by the latch. Selection of a suitable latch assembly is a matter of ordinary skill.

The shutters are suspended from the top frame member by trolleys 80, each comprising a rhomboidal hub 82 supporting a pair of wheels 84 which straddle the opening in the channel and ride in the respective tracks. The horizontal axles 86 on which the wheel are mounted are horizontally offset so that one leads the other. Each hub has a center hole 88 through which a retaining plug 90 extends. The plug has a reduced-diameter portion 92 which fits inside a counterbored bushing 94 whose outer diameter is almost as great as the width of the gap in the top member 12. A three-inch long #14 sheet metal screw 96 is passed through both the plug and bushing and threaded into the center of the inner hinge member, to retain the parts.

So that the shutter can fold, only alternating hinge joints are confined within the gaps in the top and bottom frame members by the plugs and bushings mentioned. See FIG. 2, for example. The other remaining hinges are provided with a simpler nylon spacer sleeve 98, counterbored at the top, which is held in place by a sheet metal screw threaded lengthwise into the knuckle. The shutter geometry is designed so that, when the shutter is closed, the spacer sleeves 98 bear against the extension flanges 36 of the top and bottom members. The additional bearing points provide added resistance to wind pressures.

Further protection, against both break-ins and storm forces, is provided by four latch bolts 100, two in either jamb member, top and bottom. Each latch bolt comprises a cylindrical slider 102 which can move up and down in the cylindrical recess 104 in its respective jamb. A thumb screw 106, threaded into a hole in the slider and protruding inwardly therefrom, provides means by which one can move the slider. Tightening the screw locks the bolt in position. A tapered latch pin 108 protrudes from one end of the latch bolt (upwardly, for the upper bolts, downwardly for the lower bolts). During installation, holes 110 are custom-drilled at appropriate positions (see FIG. 3) in the upper and lower members, to receive the latch pins.

In use, once the shutters have been drawn closed, the latch bolts are slid toward the respective top and bottom frame members, into the receiving holes 110. Now, wind pressure forces and impact forces on the shutter are transferred, in part, via the bolt holes to the frame members, and the shutters are kept closed, even if the latch is broken or fails.

Part of wind forces on the blades also are transferred to the upper and lower members via the hinge pins and bushings, contacting the lips of the upper and lower members, or the inwardly protruding wings. The remaining portion of such forces are delivered via the side members to the structure's wall.

Figure 10:
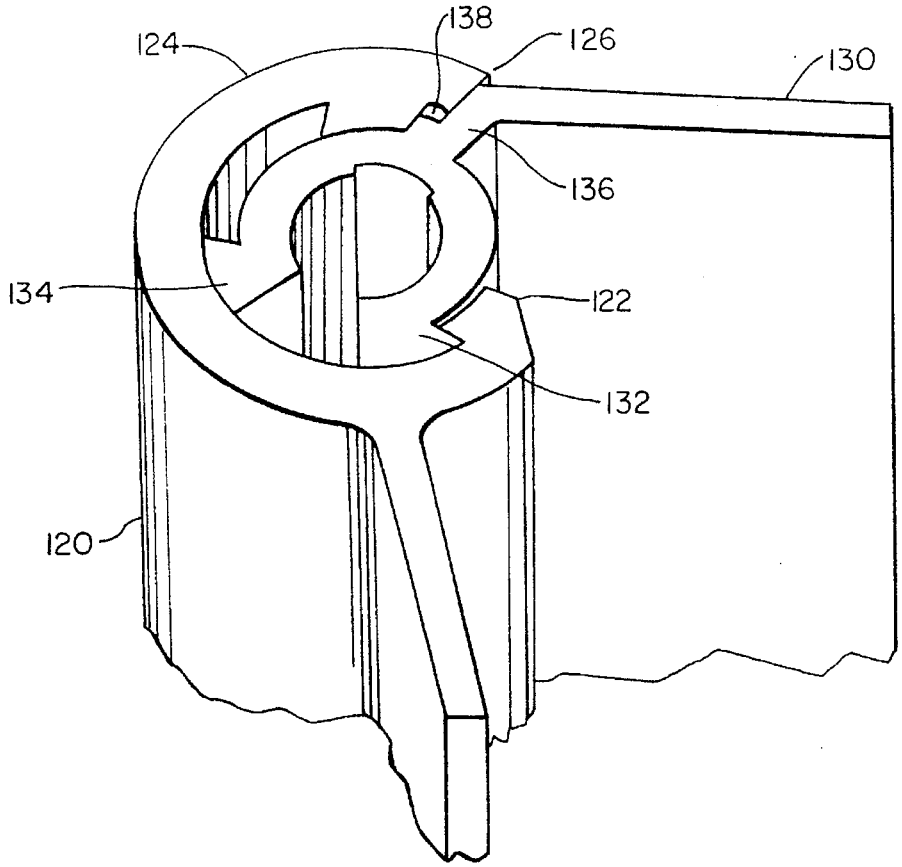
FIG. 10 is a perspective view of the upper end of an articulated hinge connection between adjacent blade elements.

The structure of the hinges themselves is important to the success of the shutter. As can be seen in FIG. 10, each hinge comprises a female cylindrical socket 120 and a smaller male knuckle 130 which can turn over a limited arc within the socket. The socket has two internal ribs 122,124, running lengthwise, and the sleeve has two external ribs 132,134 which engage the internal ribs at either extreme of motion. At maximum flexion (blades about parallel, FIG. 3), the blade arm 136 strikes the distal side of rib 122, while the proximal side surfaces of ribs 124 and 134 abut. At maximum extension (about 75°–90° between blades, FIGS. 1 and 2), the blade arm 136 strikes the plain edge 126 of the socket; simultaneously, a small shoulder 138 on the knuckle engages the distal edge of rib 124, while the ribs 122 and 132 bear against one another. The resulting three-point (actually three-line) contact provides high strength, more than adequate to prevent hinge failure. It can be seen as well that the interengaging shoulders of the ribs have a positive rake (in the range of 15°–30°), which ensures that the ribs will not slide over one another and disengage under heavy loads.

Neighboring blades are assembled by sliding the knuckle of one lengthwise into the socket of the other. We presently prefer to use an extruded 6005-T6 aluminum alloy for the frame members, and a high-strength 6063-T6 for the blades. Other materials may prove suitable, or even preferable, in various applications of this invention. Blades 0.062 inch thick, whose hinge sockets and knuckles have walls substantially thicker than the blades, test well in excess of the code specifications mentioned above, when the angle between blades (shutters closed) is about 75°–90°. Angles less than 90° are preferred, but in any event, the angle between blades should be substantially below 180°.

Figure 11:
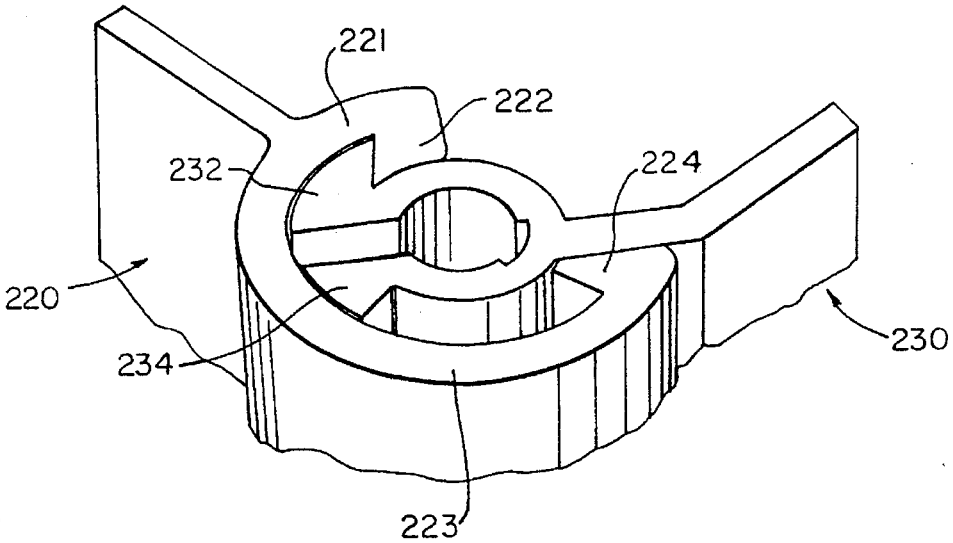
FIG. 11 is a view corresponding to FIG. 10, showing modified, lightweight blades.

The blades shown in FIG. 11 are lighter blades intended for use on lower floors, where wind loading requirements are lower. Each such blade 230 is an aluminum alloy extrusion of uniform horizontal cross-section, having a socket formed along one vertical edge, and a knuckle along the other edge. The knuckle 230 differs somewhat from that of FIG. 10, in that its legs 231,233 are not symmetrical, and it lacks structure corresponding to the shoulder 138. The small foot 234 on the leg lying toward the outside of the building (toward the viewer of FIG. 11) is less massive than the interior foot 232. One may appreciate that the primary function of the small foot is to bear against the interior wall of the socket; it need not provide much stopping strength, since the blades fold flat against each other in that direction. On the other hand, the interior foot 232 is comparatively large, since it must resist very substantial torques tending to hyperextend the joint, under hurricane conditions. Its instep has about a +30° rake, matching that of the corresponding surface on the socket. The rake of the outer foot is only about +5°. Between the socket and the knuckle, the blade varies in width, from about 0.050 inch near the socket, to about 0.062 inch near the knuckle. The wall thickness of both the knuckle and the socket is about 0.062 inch.

The outer diameter of the socket 220 is over twice that of the knuckle shell. Measuring from the blade, the shorter arm 221 has an arcuate length of about 38°, while the outer arm 223 extends over more than 180°. Each arm terminates at an inwardly protruding finger 222,224 defining a shoulder which acts as a stop when struck by the instep of the corresponding foot. The finger 222 on the shorter arm engages the larger interior foot 232, and therefore has a greater thickness, to withstand high torques in the direction of hyperextension. It inner face is cylindrical, providing a bearing surface for the O.D. of the knuckle. The smaller bearing surface on the other finger performs a similar function.

Since the invention is subject to modifications and variations, it is intended that the foregoing description and the accompanying drawings shall be interpreted as illustrative of only one form of the invention, whose scope is to be measured by the following claims.

I claim:

1. In a folding metal storm shutter blade comprising a planar metal panel having two vertical edges, and hinge coupling structures comprising a knuckle extending along one of said edges and a socket extending along the other of said vertical edges, whereby the blade can be pivotally joined to a like blade by inserting the knuckle of one into the socket of another, each said socket comprising substantially an arc of a semicircular shell having an internal first diameter, with a gap between ends of the arc, and each said knuckle being adapted to turn within the socket and having a blade arm extending therefrom through the gap, the improvement wherein said socket has inwardly directed fingers at either end of said arc, forming ribs running lengthwise of the socket, and the knuckle has outwardly directed feet, said feet and said fingers:

(a) being positioned to engage one another and together act as a stop to prevent hyperextension or hyperflexion of the coupling structure, and (b) having positive rake angles to prevent the feet and fingers from disengaging under heavy wind loads.

2. The invention of claim 1, wherein said socket arc comprises two segments of unequal length, one on either side of the socket's junction with said blade arm, the foot on the shorter of said segments engaging a respective finger on the socket to prevent hyperextension of said coupling, said foot being larger than the foot on the longer segment, and having a rake angle in the range of 15° to 30°.

3. The invention of claim 1, wherein the blade has a thickness less than the wall thickness of the socket, said blade thickness being in the range of 0.050 to 0.062 inch.

4. The invention of claim 1, wherein said socket has an outer diameter over twice that of said knuckle shell.

* * * * *